US005741157A

United States Patent [19]

O'Connor et al.

[11] Patent Number: 5,741,157

[45] Date of Patent: Apr. 21, 1998

[54] RACEWAY SYSTEM WITH TRANSITION ADAPTER

[75] Inventors: Michael R. O'Connor, Seymour; Robert A. Aekins, Stratford, both of Conn.

[73] Assignee: Hubbell Incorporated, Orange, Conn.

[21] Appl. No.: 724,255

[22] Filed: Sep. 30, 1996

[51] Int. Cl.[6] ..... H01R 13/60

[52] U.S. Cl. ..... 439/532; 439/49; 361/826

[58] Field of Search ..... 439/532, 716, 439/404, 49; 361/826, 827, 828, 627, 641

[56] References Cited

U.S. PATENT DOCUMENTS

| | | | |
|---|---|---|---|
| 4,150,867 | 4/1979 | Knickerbocker | 439/404 |
| 4,767,338 | 8/1988 | Dennis et al. | 439/55 |
| 4,932,051 | 6/1990 | Karan et al. | 361/641 |

*Primary Examiner*—Neil Abrams
*Assistant Examiner*—T. C. Patel
*Attorney, Agent, or Firm*—Jerry M. Presson; Mark S. Bicks

[57] ABSTRACT

A raceway system with a conduit, a device box and a transition adapter connects two different multi-conductor cables. The adapter includes a board holder, a printed circuit board mounted on the board holder, and input and output connectors mounted on the circuit board. The board holder has a base member and wall members extending from opposite edges of the base member. The printed circuit board has input contact areas, output contact areas and conductor traces connecting the respective contact areas. Each connector has a plurality of contacts, with each contact having a wire receiving portion and a terminal portion. The terminal portions engage and are connected to the contact areas on the circuit board. By connecting the conductors of the cables to the contact wire receiving portions, the two cables are properly connected to each other.

19 Claims, 3 Drawing Sheets

RACEWAY SYSTEM WITH TRANSITION ADAPTER

REFERENCE TO RELATED APPLICATION

This application is related to U.S. patent application Ser. No. 08/724,237, entitled Transition Adapter for Conductor Cables and concurrently filed herewith, the subject matter of which is hereby incorporated by reference.

FIELD OF THE INVENTION

The present invention relates to a raceway system with a transition adapter for electrically connecting two different multiple conductor cables. More particularly, the present invention relates to a raceway system with a transition adapter for telecommunication systems having a board holder, a printed circuit board mounted on the board holder, and connectors mounted on and electronically connected by the circuit board for receiving the conductors of the cables.

BACKGROUND OF THE INVENTION

Computer work stations must be connected to cables for receiving voice and data communications. For multiple station installations in a single room, the wiring passing through and along walls via raceway conduits comprises round conductor cables having a plurality, usually four pairs, of twisted unshielded conductors extending through each round conductor cable. From the wall, wiring is in the form of flat conductor undercarpet cables which pass from the raceway conduits into the open office or work space environments.

In wiring the various terminals, the two cables must be simply and effectively joined in a manner which does not create significant crosstalk. Additionally, the system must be highly adaptable for different work place layouts and to permit work place layouts to be changed or modified.

In typical installations, a plurality of terminals are located in a work space. Each terminal is connected to an outlet adjacent to the work station through a conventional patch cord. The outlets are connected by undercarpet or flat cables to a transition point where the undercarpet cables are connected to round conductor cables passing through raceway conduits. The round cables pass through or along walls to a cross-connect patch panel. The cross-connect patch panel is then connected to an interface equipment station through a patch cord.

SUMMARY OF THE INVENTION

An object of the present invention is to provide a raceway system with a transition adapter for connecting two different multiple conductor cables which is simple and inexpensive to manufacture and is simple to install and connect with the appropriate cables.

Another object of the present invention is to provide a raceway system with a transition adapter for connecting two different multiple conductor cables which at least satisfies the requirements for Category 5 and which reduces crosstalk.

The foregoing objects are basically obtained by a raceway system for different multiple conductor cables, comprising a raceway conduit with a channel for cables, a device box mounted on the raceway conduit and a transition adapter. The device box has first and second passageways for first and second cables separate from the conduit channel. The transition adapter includes a board holder, a printed circuit board mounted on the board holder and input and output connectors mounted on the circuit board. The board holder has a base member and wall members extending from opposite edges of the base member. The printed circuit board has input contact areas, output contact areas and conductive traces connecting each of the input contact areas with the respective output contact area. The input and output connectors have input contacts and output contacts, respectively. Each of the contacts are parallel and have a wire receiving portion and a terminal portion. The terminal portions of the input contacts engage the input contact areas. The terminal portions of the output contacts engage the output contact areas.

By forming the raceway system in this manner, the conductors from each cable can be easily and quickly terminated in a clearly identified connector and portion thereof. The system is simple and inexpensive to manufacture. The conductive traces on the circuit board can be formed in a manner, along with the contact arrangement, which reduces crosstalk.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 2:
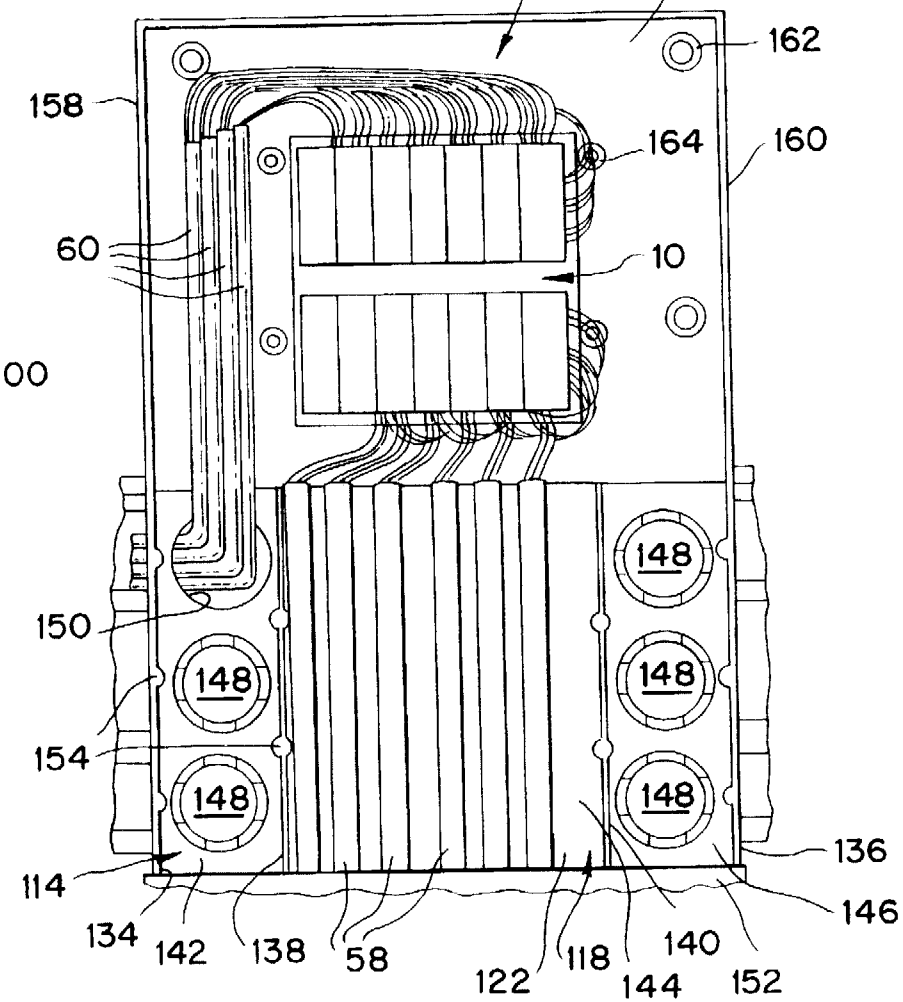
FIG. 2 is a front elevational view of the raceway system of FIG. 1 with the box shroud and cover plate removed.
Figure 1:
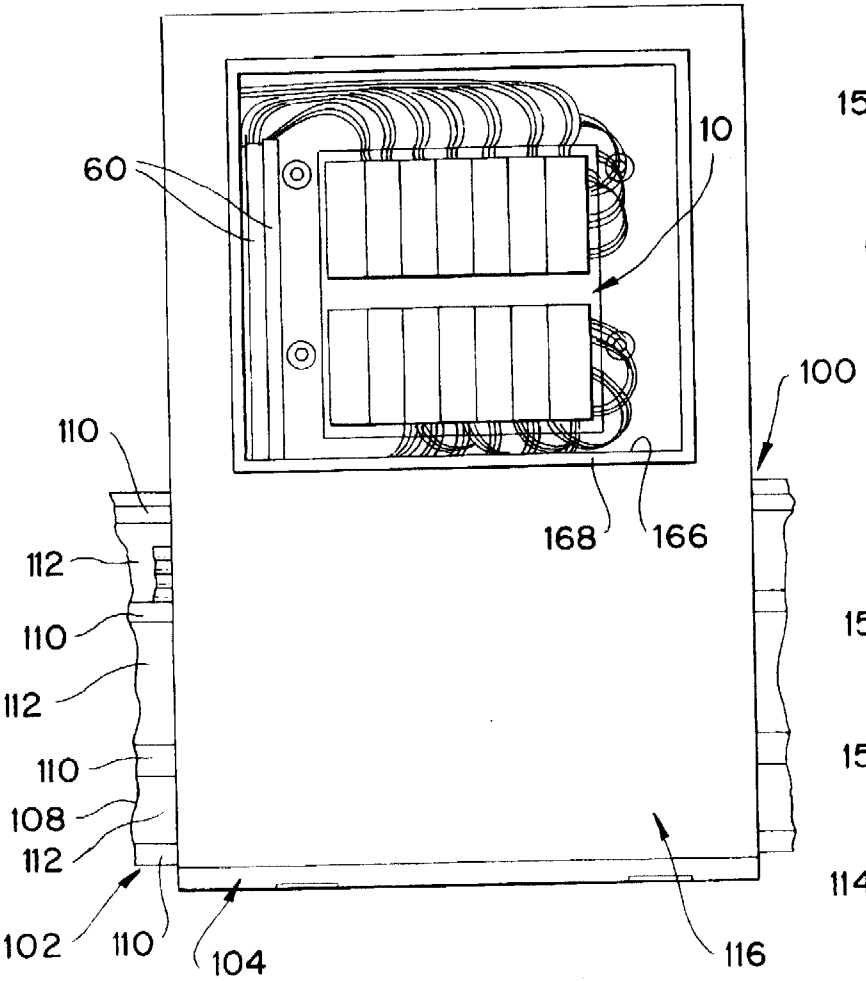
FIG. 1 is a front elevational view of a raceway system according to the present invention, with the box shroud mounted but with the cover plate removed.

The raceway system 100 according to the present invention, and as illustrated in FIGS. 1 and 2, comprises a raceway conduit 102 and a device box 104 mounted on the raceway conduit. A transition adapter 10 is mounted in the device box for connecting flat undercarpet multiple conductor cables 58 to round multiple conductor cables 60. The round multi-conductor cables extend through the conduit and into the device box. The flat multi-conductor cables extend directly into the device box from outside the raceway conduit.

Raceway conduit 102 is of generally conventional design and thus, is only relatively briefly described. The conduit comprises a base track with a back panel 108 and a plurality of walls 110 extending perpendicularly from the back panel to define a plurality of channels 112. The back panel can be secured to a building wall according to conventional practice, for example, using screw-type fasteners. After cables are received in the channels as desired, and after the device boxes 104 and other devices to be used are mounted on or adjacent to the conduit, suitable and conventional covers can be mounted over the channel to provide a decorative finish to the conduit and to hide the cables.

Device box 104 comprises a base 114 and a cover shroud 116. Base 114, as best illustrated in FIG. 2, comprises a lower conduit connection portion 118 and an upper adapter portion 120. The conduit connector portion includes a planar back panel 122 which overlies raceway conduit 102 and engages the free ends of conduit walls 110.

End walls 134 and 136 and intermediate walls 138 and 140 are parallel and extend perpendicularly from back panel 122 along the entire vertical length of the conduit portion. Walls 134 and 138 define a first section 142 therebetween. Walls 138 and 140 define a second section 144 therebetween. Walls 140 and 136 define a third section 146 therebetween. Each of these three sections defines a passageway for receiving and conveying cables.

Each of the first and third sections 142 and 146 have a plurality of punchouts 148. According to conventional practice, each punchout is connected by frangible portions to back panel 122. When desired, frangible portions are broken to remove the punchout and to provide an opening 150 extending through back panel 122 of the device box. The opening 150 allows cables 160 to pass from channel 112 in raceway conduit 102 into the inside of the outlet box and into and along the passageway of first section 142, and into adapter portion 120 for connection to adapter 10. The passageway of the third section 146 with its punchouts 148 can be used in a manner similar to the first section for conveying cables between the conduit and the inside of the device box.

The passageway provided by second section 144 is intended for the flat undercarpet multi-conductor cables 58 as they exit carpet 152. The second section overlies the raceway conduit, thereby providing a passage for flat cable 56 over the raceway conduit and outside of the raceway conduit from a location below the raceway conduit and into adapter portion 120 for connection to adapter 10.

Suitable reinforces 154 can be provided on the walls 134, 136, 138 and 140.

Adapter portion 120 comprises a planar Lack panel 156 and side walls 158 and 160. Side wall 158 is a coplanar extension of end wall 134, while side wall 160 is a coplanar extension of end wall 136. Back panels 144 and 156 are parallel and offset. The side walls are perpendicular to back wall 156.

Back wall 156 has a plurality of punchouts 162. Punchouts 162 can be removed from the back panel to provide openings for fasteners to secure the device box to a building wall. The adapter portion back panel also provides a suitable mounting for adapter 10. Adjacent the area for mounting adapter 10, back panel 156 has internally threaded posts 164. Posts 164 are provided to receive fasteners for attaching a cover plate.

Cover shroud 116 is of generally conventional configuration having means for connection by snapping or otherwise to base 114. The lower portion of cover shroud 116 covers conduit portion 118. The portion of the cover shroud that overlies adapter portion 120 is provided with an opening 166 surrounded by a peripheral recess 168. Recess 168 can receive the peripheral portion of a rectangular cover plate (not illustrated) to close opening 166. The cover plate is secured in place by fasteners passing through the cover plate and into the threaded interiors of posts 164. The engagement of the recess and the peripheral portion of the cover plate, with the attaching fasteners within posts 164, assist in securing the cover shroud 116 to base 114.

Figures 3, 4:
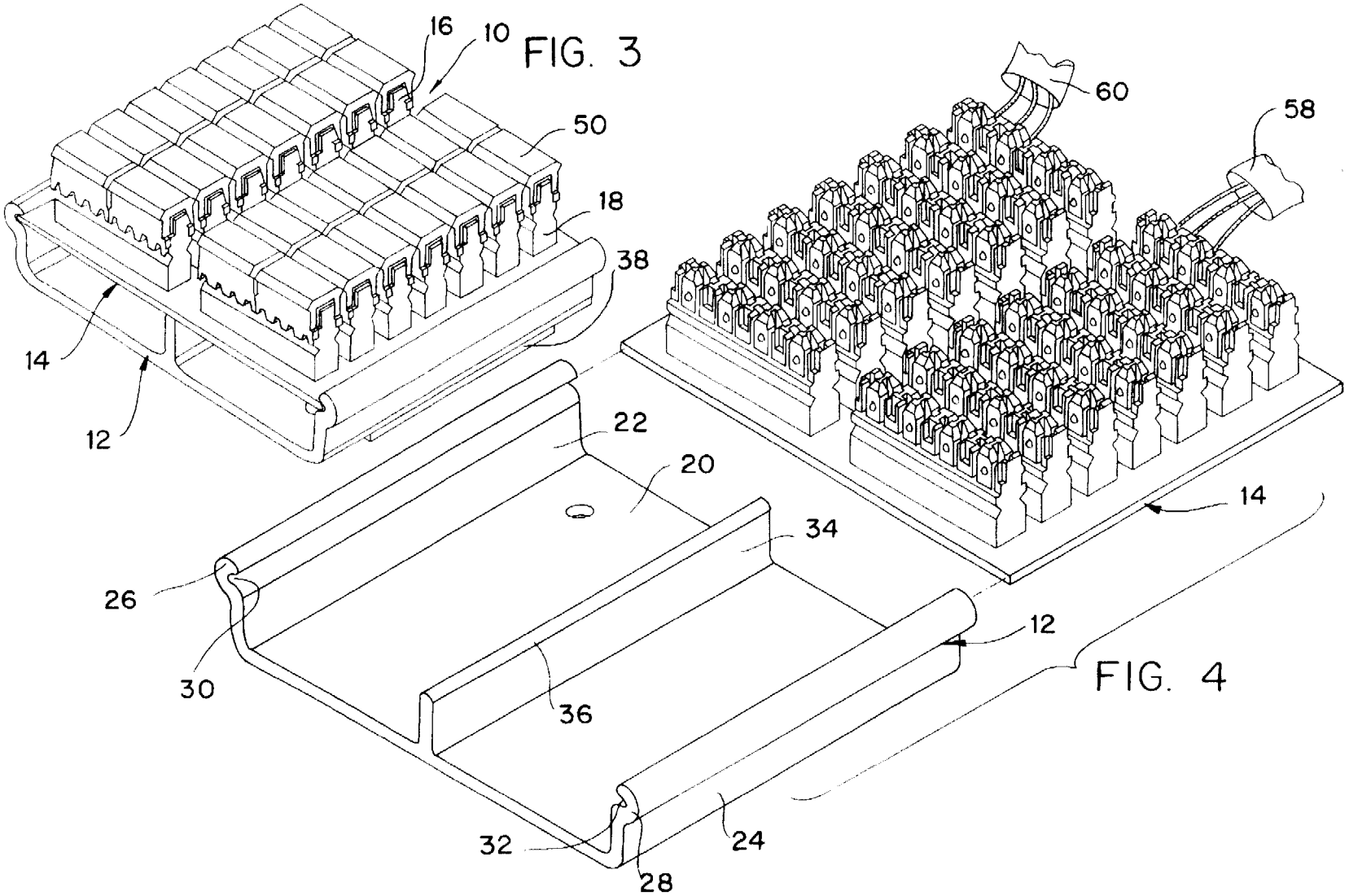
FIG. 3 is a perspective view of the transition adapter of FIG. 1.
FIG. 4 is an exploded, perspective view of the transition adapter FIG. 1 with the connector caps removed.
Figure 5:
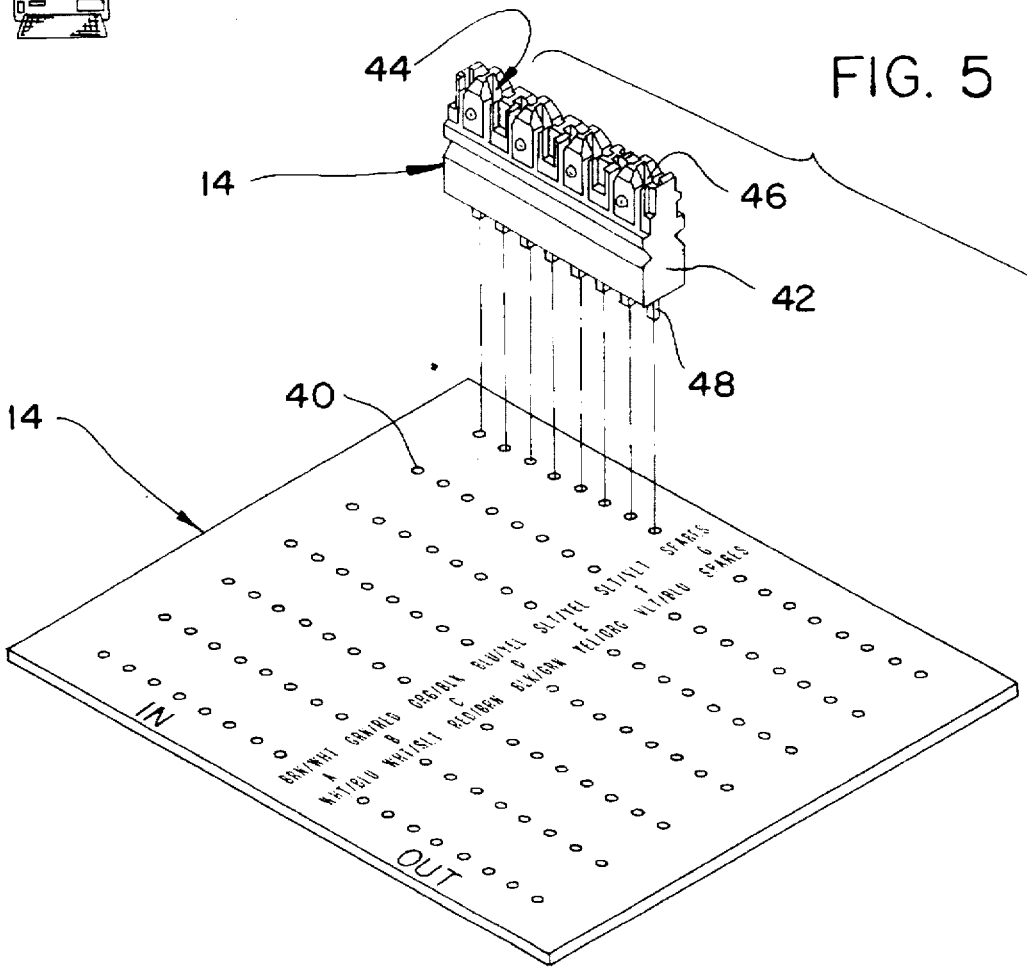
FIG. 5 is a partial, perspective view of one connector and the circuit board of the transition adapter of FIG. 1.

The transition adapter 10 according to the present invention and as illustrated in detail in FIGS. 3–5 comprises a board holder 12, a printed circuit board 14 mounted on the board holder, and input and output connectors 16 and 18, respectively, mounted on the circuit board. The transition adapter connects the respective conductors in two different multi-conductor cables by means of the contacts within the input and output conductors and conductive traces formed on the circuit board connecting the contacts of the connectors.

As best illustrated in FIG. 4, board holder 12 comprises a substantially planar base member 20 of rectangular configuration. Wall members 22 and 24 extend perpendicularly from opposite side edges of base member 20. Wall members 22 and 24 have C-shaped sections 26 and 28 extending along the lengths of the free edges of the wall members remote from the base member. The inner surfaces of the C-shaped sections 28 and 26 define grooves 30 and 32, respectively, which face one another and are spaced from the base member for receiving opposite edges of circuit board 14.

A support member 34 extends upwardly and perpendicularly from base member 20 equally spaced from and parallel to wall members 22 and 24. The support member has a free end 36 remote from base member 20 for engaging and supporting a surface of circuit board 14.

A strip of tape 38 is provided on the exterior surface of base member 20, i.e., the surface opposite the surface thereof from which the wall members and support member extend. Tape 38 has adhesive on both sides for adhering and mounting the board member to back panel 156 of device box 104.

Printed circuit board 14 comprises a planar, rectangular base of dielectric material. For each connector in the illustrated embodiment, the board has a series of through holes 40. The holes are arranged in groups of eight, for each connector, oriented along a single straight line. For the seven input connectors 16 and the seven output connectors 18, there are 14 sets of holes. Each hole is plated with copper plating with a solder coating constituting 50 to 70 percent tin. Additionally, around each hole is a pad of conductive material having a diameter larger than the drilled hole. The plated through holes and pads form contact areas for the connectors. Printed circuit board traces are provided on circuit board 14 to connect each input hole with the respective output hole.

The conductive traces on the circuit board are arranged to reduce crosstalk. Such arrangements can be formed according to the teachings of U.S. Pat. No. 5,432,484 to Klas et al. entitled Connector for Communication Systems with Canceled Crosstalk and issued Jul. 11, 1995, and U.S. Pat. No. 5,414,393 to Rose et al. entitled Telecommunication Connector with Feedback and issued May 9, 1995, the subject matters of which are hereby incorporated by reference.

Suitable legends are provided on the circuit board to clearly identify the respective connectors connected or mounted on the circuit board. The legends are located in board areas which are exposed when the connectors are mounted thereon. These exposed legends facilitate installation and connection of the appropriate conductor cables.

Since each connector is formed of identical configuration, only one will be described in detail. Each input and output connector is of conventional design having a plastic body 42 with a contact support and conductor guide structure formed therein. The contacts 44 supported and received within body 42 are of the 110D type laid out in a continuous, parallel fashion to maintain a crosstalk value of greater than –40dB.

Each contact has a wire receiving portion 46 and a depending terminal portion 48. The wire receiving portions receive the individual conductors from the cables as graphically illustrated in FIG. 3. Terminal portions 48 are fitted within holes 40 and make electrical contact with the circuit board conductive pads and traces.

After the appropriate cable conductors are placed within the respective wire receiving portions, conventional caps 50 are attached on the end of conductor body 42 remote from terminal portions 48. The caps secure the cable conductors within the respective cable receiving portions of the connectors 42.

Figure 6:
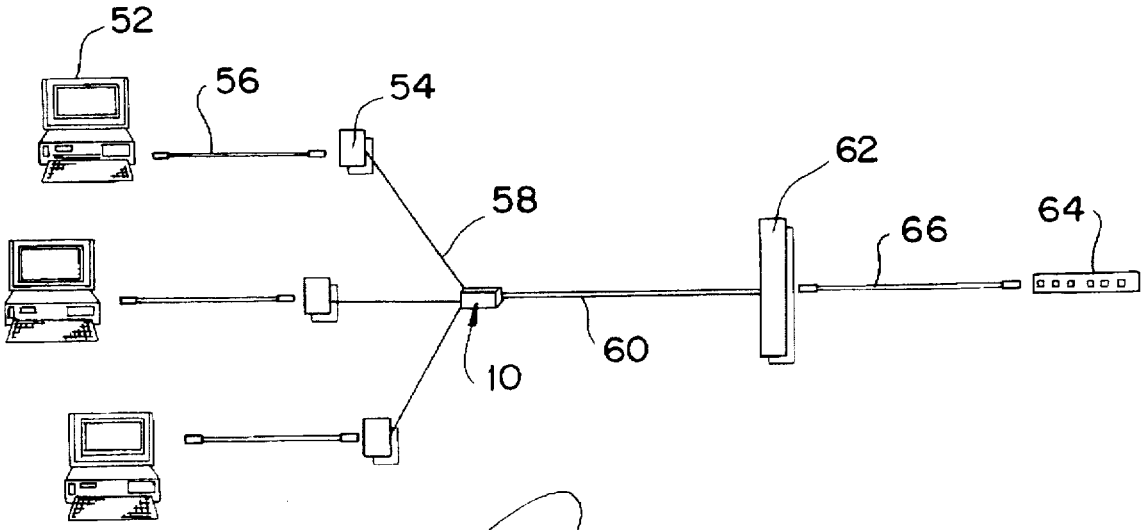
FIG. 6 is a graphical illustration of a voice and/or data transmission system employing the raceway system of FIG. 1 according to the present invention.

A typical use of the transition adapter of the present invention is graphically illustrated in FIG. 6. Computer terminals 52 are connected to modular jacks 54 by patch cords 56. The individual jacks 54 are connected to a transition adapter 10 according to the present invention by flat undercarpet cables 58. The undercarpet cable is of the type usually housing four unshielded twisted pairs of conductors. The conductors of cables 58 are connected to the output connectors 18 of transition adapter 10. Round cables 60 have their individual conductors connected with the respective portions of the respective input connectors 16. The opposite end of the round cable 60 are connected to a cross-connect patch panel 62. Patch panel 62 is connected to interface station equipment 64 by a patch cord 66. In this manner, the connection of the two different types of cable, flat cable 56 and round cable 60, is facilitated through the transition adapter.

While a particular embodiment has been chosen to illustrate the invention, it will be understood by those skilled in the art that various changes and modifications can be made therein without departing from the scope of the invention as defined in the appended claims.

What is claimed is:

1. A raceway system for different multiple conductor cables, comprising:

a raceway conduit having at least one channel for receiving first multiple conductor cables;

a device box mounted on said raceway conduit having a first passageway for receiving the first cables extending from said channel and a second passageway for receiving second multiple conductor cables which do not pass through said channel; and a transition adapter for connecting respective conductors of the first and second cables mounted in said device box, said transition adapter including a board holder having a base member and wall members extending from opposite edges of said base member, a printed circuit board mounted on said board holder and having first input contact areas, first output contact areas and first conductive traces connecting each of said first input contact areas with the respective first output contact areas, and a first input connector and a first output connector mounted on said circuit board and having first input contacts and first output contacts, respectively, each of said contacts being parallel and having a wire receiving portion and a terminal portion, said terminal portions of said first input contacts engaging said first input contact areas, said terminal portions of said first output contacts engaging said first output contact areas.

2. A raceway system according to claim 1 wherein round, multiple conductor cables extend through said raceway conduit and into said box, with conductors thereof connected to respective input contacts; and flat, multiple conductor cables extend through said device box, with conductors thereof connected to respective output contacts.

3. A raceway system according to claim 1 wherein said wall member of said board holder comprises elongated grooves facing one another and spaced from said base member; and opposite edges of said circuit board are received in said grooves.

4. A raceway system according to claim 1 wherein said board holder comprises a center support extending from said base member and between and substantially parallel to said wall members, said center support having a free end remote from said base member engaging said circuit board.

5. A raceway system according to claim 1 wherein said base member of said board holder comprises means for mounting said board holder on a panel in said device box.

6. A raceway system according to claim 1 wherein said device box comprises a conduit connection portion mating with said raceway conduit and an adapter portion receiving and mounting said transition adapter.

7. A raceway system according to claim 6 wherein said conduit connection portion comprises a first section overlying said raceway conduit and having at least one opening and walls conducting the first cables into said adapter portion, and a second section overlying said raceway conduit and having a passageway for conducting the second cables over said raceway conduit from a location below said raceway conduit and into said adapter portion.

8. A raceway system according to claim 7 wherein said conduit connection portion comprises a third section overlying said raceway conduit and having at least one opening and walls conducting the first cables between said raceway conduit and said adapter portion, said second section being between said first and third sections.

9. A raceway system according to claim 7 wherein said raceway conduit comprises a plurality of channels; and said first section comprises a corresponding plurality of openings.

10. A raceway system according to claim 7 wherein said second section closes said conduits such that said passageway of said second section conducts the cables into said adapter portion without entering said conduit.

11. A raceway system according to claim 1 wherein said circuit board has second input contact areas, second output contact areas and second conductive traces connecting each of said second input contact areas with the respective second output contact area; and a second input connector and a second output connector are mounted on said circuit board and have second input contacts and second output contacts, respectively, each of said second contacts being parallel and having a wire receiving portion and a terminal portion, said terminal portions of said second input contacts engaging said second input contact areas, said terminal portions of said second output contacts engaging said second output contact areas.

12. A raceway system according to claim 11 wherein each of said second contacts are substantially coplanar, and are located in a plane parallel to said first contacts.

13. A raceway system according to claim 1 wherein each of said contacts are substantially coplanar.

14. A raceway system according to claim 13 wherein said circuit board has third input contact areas, third output contact areas and third conductive traces connecting each of said third input contact areas with the respective third output contact area; and a third input connector and a third output connector are mounted on said circuit board and have third input contacts and third output contacts, respectively, each of said third contacts being parallel and having a wire receiving portion and a terminal portion, said terminal portions of said third input contacts engaging said third input contact areas, said terminal portions of said third output contacts engaging said third output contact areas.

15. A raceway system according to claim 14 wherein each of said second and third contacts are substantially coplanar in respective parallel planes parallel to said first contacts.

16. A raceway system according to claim 7 wherein said conduit connecting portion and said adapter portion are connected end-to-end along a device axis; and said raceway conduit extends along a conduit axis oriented substantially perpendicular to said device axis.

17. A raceway system according to claim 16 wherein said conduit connection portion directly overlies said raceway conduit; and said adapter portion is spaced laterally from said raceway conduit.

18. A raceway system for different multiple conductor cables, comprising:

a raceway conduit having channels for receiving first multiple conductor cables;

a device box having a conduit connection portion mounted on and mating with said raceway conduit and an adapter portion connected to an end of said conduit connection portion and spaced laterally of said raceway conduit, said conduit connection portion including a first section overlying said raceway conduit and having openings and walls conducting the first cables into said adapter portion, including a second section overlying and closing said raceway conduit and having a passageway for conducting the second cables over said raceway conduit from a location below said raceway conduit and into said adapter portion, and including a third section overlying said raceway conduit and having openings and walls conducting the first cables between said raceway conduit and said adapter portion, said second section being between said first and third sections; and a transition adapter, mounted in said adapter portion, for connecting respective conductors of the first and second cables mounted in said device box, said transition adapter including a board holder having a base member and wall members extending from opposite edges of said base member, a printed circuit board mounted on said board holder and having first input contact areas, first output contact areas and first conductive traces connecting each of said first input contact areas with the respective first output contact areas, and a first input connector and a first output connector mounted on said circuit board and having first input contacts and first output contacts, respectively, each of said contacts being parallel and having a wire receiving portion and a terminal portion, said terminal portions of said first input contacts engaging said first input contact areas, said terminal portions of said first output contacts engaging said first output contact areas.

19. A raceway system according to claim 18 wherein round, multiple conductor cables extend through said raceway conduit and into said box, with conductors thereof connected to respective input contacts; and flat, multiple conductor cables extend through said device box, with conductors thereof connected to respective output contacts.

* * * * *